US006886762B2

(12) United States Patent
Angelino et al.

(10) Patent No.: US 6,886,762 B2
(45) Date of Patent: May 3, 2005

(54) NOZZLE INSERT FOR DUAL MODE FUEL INJECTOR

(75) Inventors: Joseph Angelino, Columbia, SC (US); Scott F. Shafer, Morton, IL (US); Charles Bates, Peoria, IL (US); Jay E. Tomaseski, Gainesville, GA (US); Clifford E. Cotton, III, Pontiac, IL (US); Alan R. Stockner, Metamora, IL (US); Colby Buckman, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 130 days.

(21) Appl. No.: 10/029,409

(22) Filed: Dec. 20, 2001

(65) Prior Publication Data

US 2003/0116660 A1 Jun. 26, 2003

(51) Int. Cl.[7] ..... B05B 1/00

(52) U.S. Cl. ..... 239/596; 239/533.11; 239/533.2; 239/88; 251/360; 123/299

(58) Field of Search ..... 239/546, 533.4, 239/533.11, 533.2, 88; 123/299, 300, 467; 251/360, 362

(56) References Cited

U.S. PATENT DOCUMENTS

| | | | | | |
|---|---|---|---|---|---|
| 1,607,805 | A | * | 11/1926 | Sprado | 239/464 |
| 1,834,061 | A | * | 12/1931 | Joachim | 239/533.4 |
| 3,510,062 | A | * | 5/1970 | Waldman | 239/96 |
| 3,788,546 | A | * | 1/1974 | Bailey et al. | 239/533 |
| 4,205,790 | A | * | 6/1980 | Keiczek | 239/533.4 |
| 4,526,323 | A | * | 7/1985 | Seifert | 239/533.4 |
| 4,544,096 | A | * | 10/1985 | Burnett | 239/92 |
| 4,856,713 | A | | 8/1989 | Burnett | |
| 5,458,292 | A | * | 10/1995 | Hapeman | 239/533.4 |
| 5,983,855 | A | * | 11/1999 | Benedikt et al. | 123/297 |

* cited by examiner

*Primary Examiner*—Dinh Q. Nguyen
(74) *Attorney, Agent, or Firm*—Liell & McNeil

(57) ABSTRACT

A nozzle insert that is capable of being irreversibly attached to a needle valve tube such that the resulting needle valve member can be used in a nested needle valve configuration for a dual mode fuel injector.

19 Claims, 8 Drawing Sheets

NOZZLE INSERT FOR DUAL MODE FUEL INJECTOR

TECHNICAL FIELD

This invention relates generally to fuel injectors capable of dual modes of injection, and more particularly to a needle valve nozzle insert associated with such a dual mode injector.

BACKGROUND

In an effort to reduce emissions and to comply with more strict clean air standards, manufacturers of various diesel engine components have begun exploring an alternative engine strategy commonly referred to as homogeneous charge compression ignition (HCCI). An HCCI injection differs from a traditional diesel injection in that an HCCI injection introduces fuel into the engine cylinder near bottom dead center of the compression stroke as opposed to near top dead center, as in conventional diesel operation. This operational adjustment allows the diesel fuel and air to become a relatively lean, homogeneous mixture unlike a traditional injection system. Scientific research has found that the resulting homogeneous mixture burns more cleanly and efficiently. At the same time, engineers discovered that an HCCI injection lost its efficiency advantages as the engine was operated under larger load conditions, and the traditional injection strategy appeared preferable under such large load circumstances.

Based on the engineering and scientific research, previous art in HCCI research taught using two separate fuel injectors, one for traditional diesel ignition under high load conditions, and one for HCCI injection under lower load conditions. While two fuel injectors can enable dual modes of operation, it can be appreciated that a single fuel injector capable of both HCCI and traditional injection would be advantageous because it would have less components prone to failure or malfunction. Therefore, a need was created for a fuel injector that would facilitate the fuel spray into the engine cylinder under both traditional and HCCI fuel injection operations.

One known strategy for having a dual mode fuel injector is achieved with a nested needle arrangement or a dual concentric needle arrangement. A nested needle arrangement has proven problematic because engineers have found that boring a hole with the necessary length and diameter, as well as grinding the corresponding valve seat deep inside the bore was difficult to impossible to accomplish with conventional machining techniques.

Previous art in the area is described in U.S. Pat. No. 4,856,713, which issued to Burnett on Aug. 15, 1989 and is entitled Dual Fuel Injector. This patent teaches a fuel injector that is capable of injecting both liquid and slurry fuels. To accomplish this task, two defined sets of openings were manufactured into the fuel injector, one for the liquid fuel and one for the slurry fuel. The two definite openings were accomplished by threadably coupling a replaceable tip to the outlet end of the nozzle valve structure. The replaceable tip contained an outlet, an outer valve surface and an inner valve seat. Burnett taught that threading of the replaceable tip with the valve structure is utilized for easy removal and replacement of tip section.

The injector taught by Burnett is not useful in diesel engines running under high pressure and requiring well-filtered diesel fuel. Threading, by its nature, cannot reliably produce a proper centerline alignment needed for this type of fuel injector having very tight diametrical clearances between its moving parts. Threading is not a permanent binding method; threading of mating sections requires tiny openings and irregularities so the two sections can be attached and unattached without much difficulty. Furthermore, a dual fuel injector of this type must be centered along a central axis; any disruption in the concentricity could cause a malfunction of the fuel injection process, such as a jammed or stuck needle. Once again, a threaded model, by its nature, cannot assure that the needle valve would be concentric. Therefore, the teaching of threading and removability is not helpful for the type of dual fuel injectors necessary for distillate diesel fuel injection systems.

The present invention is directed to overcoming one or more of the problems set forth above.

SUMMARY OF THE INVENTION

In one aspect of the present invention, a fuel injector nozzle insert includes a metallic body having a first end separated from a second end by a circumferential side surface, at least one nozzle outlet that opens through the first end, and at least one passage opening through the second end. A portion of the at least one passage being an annular valve seat on the metallic body. The circumferential side surface includes an annular valve surface positioned between a first cylindrical surface and a second cylindrical surface.

In another aspect of the present invention, a needle valve member for a fuel injector includes a nozzle insert and a tube. The nozzle insert has an external valve surface, an internal valve seat and at least one nozzle outlet. The tube is irreversibly attached to the nozzle insert.

In still another aspect of the present invention, a method of making a needle valve member for a fuel injector includes a step of forming a nozzle insert to include an annular valve seat and an annular valve surface. At least one nozzle outlet is machined through an end of the nozzle insert. Finally, the nozzle insert is irreversibly attached to a tube.

DETAILED DESCRIPTION

Figure 1A:
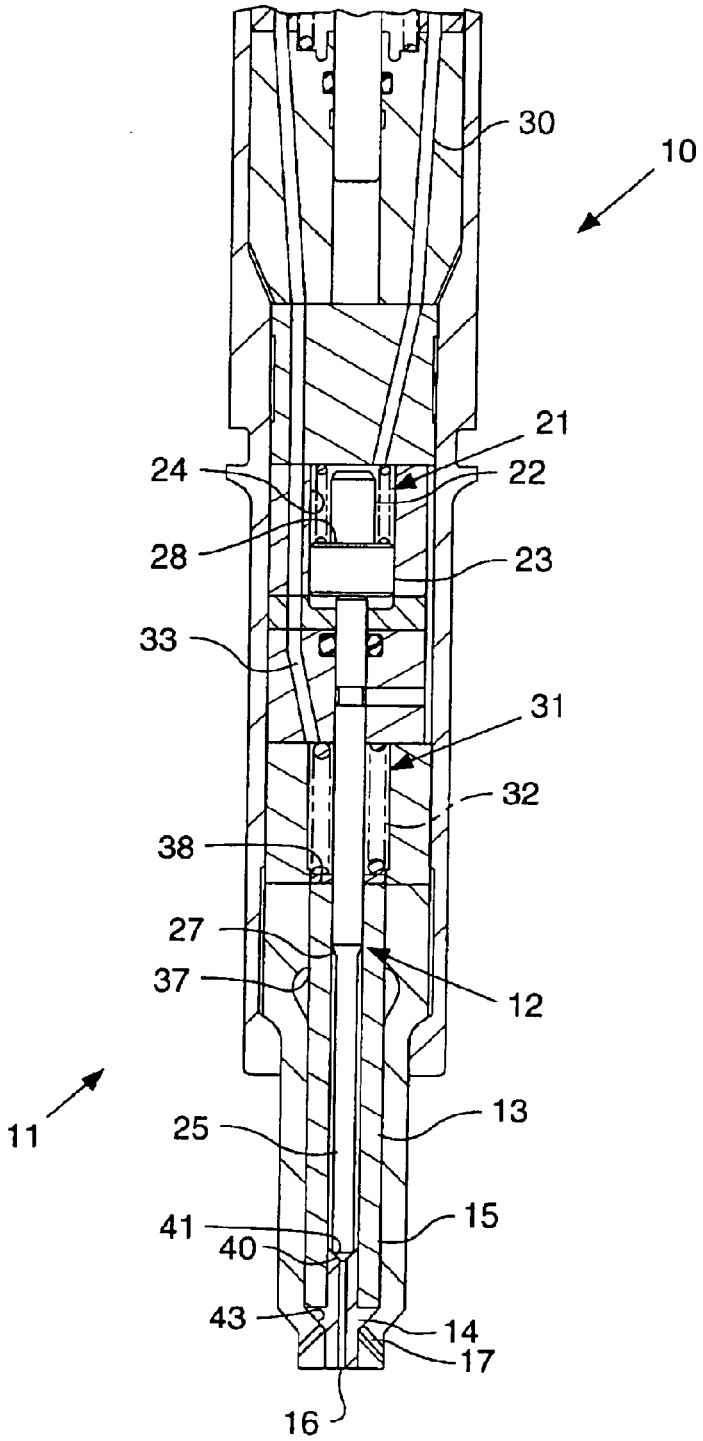
FIG. 1*a* is a partial sectioned view of a fuel injector according to the present invention, specifically showing the control pressure lines.
Figure 1B:
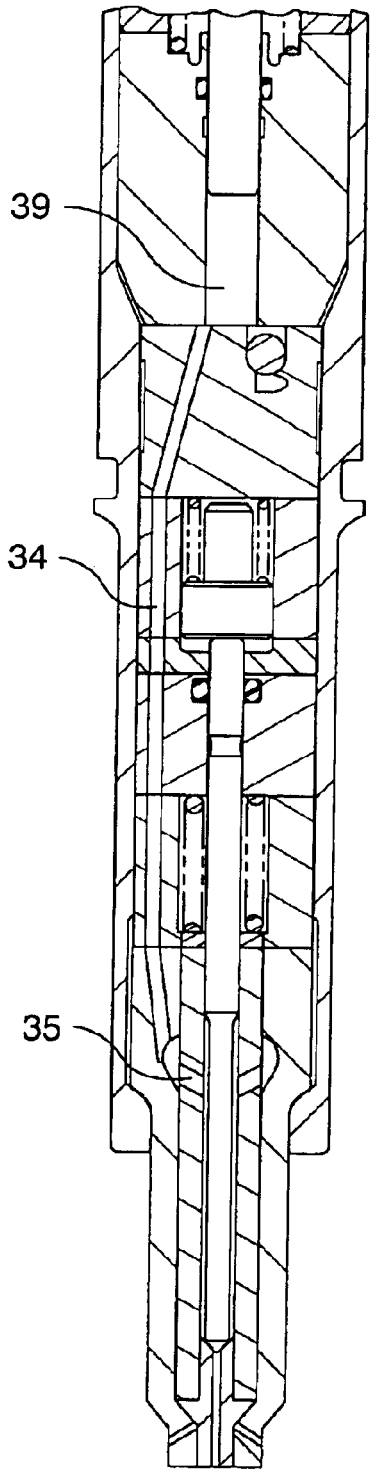
FIG. 1*b* is a partial sectioned side view of the fuel injector of FIG. 1*a*, specifically showing the nozzle supply line.

Referring to FIGS. 1*a–b*, sectioned views of a dual fuel injector 10 are shown. FIGS. 1*a–b* are detailing the same dual fuel injector 10 except that FIG. 1*a* displays the control pressure lines while FIG. 1*b* displays fuel supply passage. Dual fuel injector 10 is represented with a needle valve 11 that includes an HCCI needle valve member 12 nested inside conventional injection needle valve member 13. Conventional needle valve member 13 includes a lower portion, noted as nozzle insert 14, and an upper portion, noted as tube 15.

HCCI needle valve member 12 is movable between an upward open position and a downward closed position, and is biased toward its closed position (as shown in FIGS. 1*a–b*) by HCCI biasing spring 21. Conventional needle valve member 13 contains a fuel transfer passage 35 which fluidly joins nozzle supply passage 34 and fuel pressurization chamber 39 with the HCCI nozzle outlet 16 when the HCCI needle valve member 12 is in its open position. It can be appreciated by one skilled in the art that the fuel pressurization chamber 39 could be replaced with an equally effective means, now known or contemplated in the future, of delivering fuel to the HCCI nozzle outlets 16 such as a common rail arrangement. HCCI needle valve member 12 includes an HCCI stop pin 22 that defines the travel distance between the open and closed positions. HCCI needle valve member 12 also includes piston portion 23 that provides a closing hydraulic surface 28 exposed to fluid pressure in an HCCI needle control chamber 24, which is fluidly connected to HCCI control pressure line 30. HCCI needle valve member also includes a needle portion 25 that provides an opening hydraulic surface 27 exposed to the fluid pressure in HCCI nozzle chamber 26.

When HCCI control chamber 24 is exposed to high pressure via HCCI control pressure line 30, HCCI needle valve member 12 will remain in or move toward its closed position, even when fuel pressure in nozzle chamber 26 is at injection levels. When the needle valve member is in its closed position HCCI needle valve member 12 blocks nozzle supply passage 34 from fluid communication with single HCCI nozzle outlet 16. However, when HCCI needle control chamber 24 is under low pressure and opening hydraulic surface 27 is exposed to a particular HCCI valve opening pressure inside nozzle chamber 26, needle valve member 12 can be lifted against the bias of biasing spring 21 toward its open position. As a result, the conical HCCI valve surface 40 is lifted from its biased position on HCCI valve seat 41 (better demonstrated in FIG. 2), and fuel can spray out of HCCI nozzle outlet 16.

Referring back to conventional needle valve member 13 which also has an open and closed position similar to HCCI needle valve member 12. Conventional needle valve member 13 has a closing hydraulic surface 38 that is exposed to a fluid pressure in the conventional needle control chamber 32, which is fluidly connected to control pressure line 33. Conventional needle valve member 13 also contains an opening hydraulic surface 37, which is exposed to the fluid pressure in nozzle supply passage 34. Conventional biasing spring 31 is used to bias the conventional needle valve member toward its closed position (as shown in FIGS. 1*a–b*), therefore blocking conventional nozzle outlets 17. When the fuel pressure force acting on opening hydraulic surface 37 exceeds the fluid pressure acting on closing hydraulic surface 38, the biasing force exerted by conventional biasing spring 31, the fluid pressure acting on closing hydraulic surface 28 and the biasing force exerted by HCCI biasing spring 21 (i.e. conventional valve opening pressure), conventional needle valve member is raised toward its open position. Once the conventional valve surface 42 is not in connection with conventional valve seat 43, nozzle supply passage 34 is fluidly connected to conventional nozzle outlet 17 and fuel can be injected. In addition to the conventional needle valve member 13 moving upward, the HCCI needle valve member 12 is raised as a result of the conventional valve opening pressure acting on conventional needle valve member 13.

Note that when HCCI needle valve member 12 is raised during conventional fuel injection, HCCI valve surface and HCCI valve seat remain in contact at all times. This is due to two factors. First, the valve opening pressure for conventional needle valve member 13 is less than the valve opening pressure for HCCI needle valve member 12. In other words, when low pressure is acting on both HCCI closing hydraulic surface 28 and conventional closing hydraulic surface 38, the conventional needle valve opening pressure will be reached prior to the HCCI valve opening pressure being reached. It should be appreciated that because conventional needle valve member 13 must overcome the forces of HCCI biasing spring 21 and conventional biasing spring 31, opening hydraulic surface 37 should be sized appropriately with respect to opening hydraulic surface 27 to allow for a lower conventional valve opening pressure than the HCCI valve opening pressure. Therefore, conventional needle valve member 13 will be moving toward its opening position before HCCI needle valve member 12 can move toward its opening position. Secondly, HCCI stop pin 22 limits the movement of HCCI needle valve member 12 such that the HCCI needle valve member is prevented from separating the HCCI valve surface 40 from HCCI valve seat 41.

Figure 2:
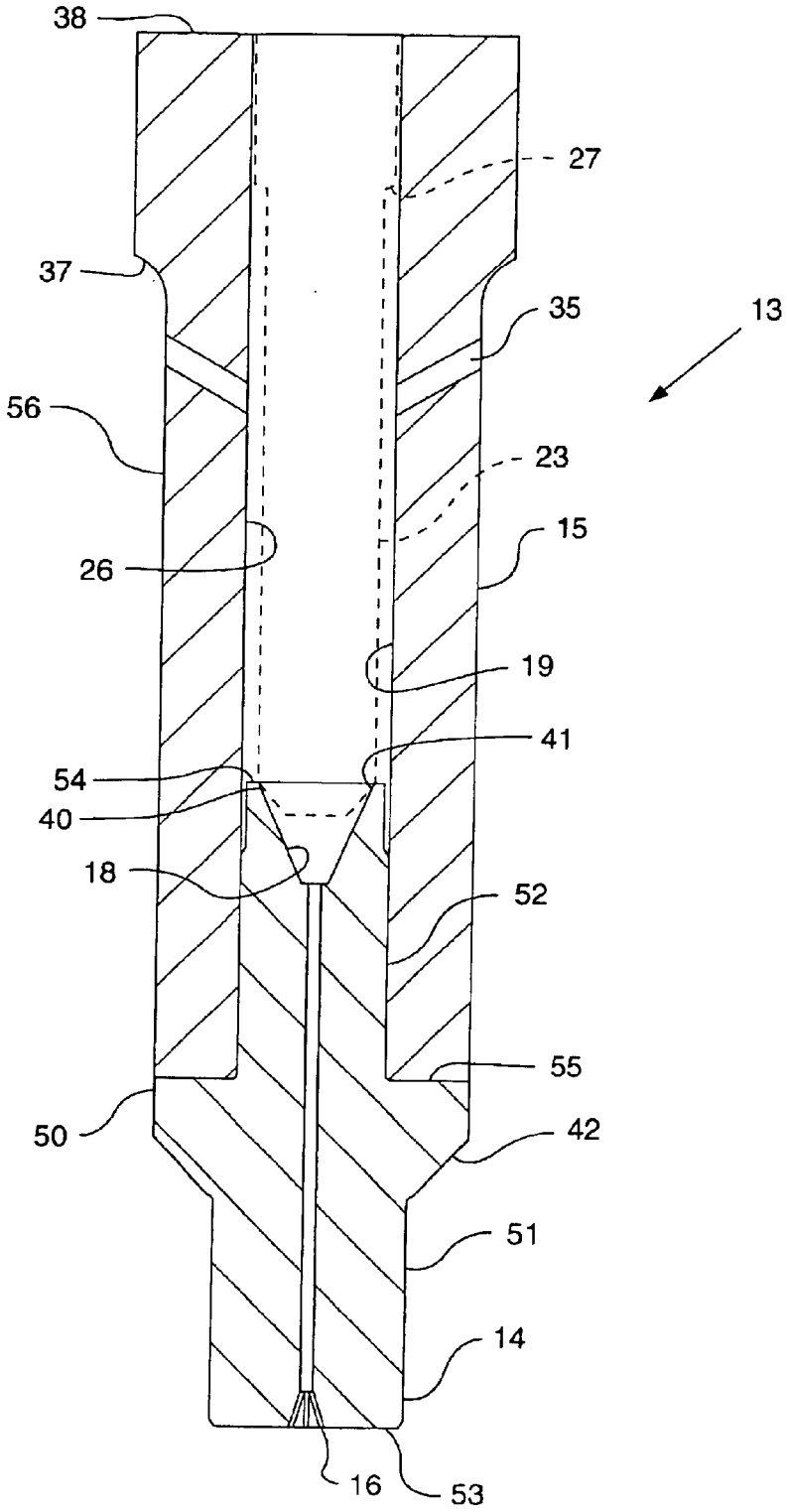
FIG. 2 is a sectioned front view of a two piece needle valve member according to the present invention.

Referring now to FIG. 2, a sectioned front view of a conventional needle valve member 13 is shown with nozzle insert 14 and tube 15. FIG. 2 details the finer features of the conventional needle valve member 13 which might have been unclear from FIG. 1. Nozzle insert 14 and tube 15 are preferably press fit together and welded so the resulting conventional needle valve member 13 will behave as a single metallic piece incapable of being separated.

Nozzle insert 14 is a metallic body 60 having a first end 53 separated from a second end 54 by a circumferential side surface 50. Circumferential side surface 50 includes an annular conical valve surface 42 positioned between a first cylindrical surface 51 and a second cylindrical surface 52. Preferably, the first cylindrical surface 51 has a guide diameter that is smaller than its guide length. Also, the second cylindrical surface 52 preferably has a mating diameter that is smaller than its mating length. Furthermore, the annular conical valve surface 42 includes a frustoconical portion. Nozzle insert 14 contains one or more HCCI nozzle outlets 16 that are used when dual fuel injector 10 is in an HCCI mode of operation. Opposite the HCCI nozzle outlet 16 end of nozzle insert 14 is a passage 18 with a portion being an annular conical HCCI valve seat 41.

Preferably nozzle insert 14 contains an abutment surface 55 that is adjacent and perpendicular to the second cylindrical surface 52. Abutment surface 55 is the connection plane for tube 15. It can be appreciated that the second cylindrical surface 52, which could be considered a male mating surface, of nozzle insert 14 has only a slightly different diameter than the inner surface 19, which could be considered a cylindrical female mating surface of tube 15. These dimensions are such that the tube 15 and nozzle insert 14 can be pressed fit and welded together to form a single metallic piece. Any irregularities in the cylindrical nature of these pieces might cause friction or unwanted pressure points that could cause fuel injection failure. The press fitting and welding will create a single metallic piece that is irreversibly attached to avoid the possibility of needle breakage. One skilled in the art can appreciate that the conventional needle valve member 13 and the HCCI needle portion 25 should be closely concentric about a centerline through needle valve 11. This alignment is needed to avoid sided forces when HCCI valve surface 40 contacts HCCI valve seat 41.

Referring back to FIG. 2, the hydraulic and valve surfaces are more clearly identified. Opening hydraulic surface 37 and closing hydraulic surface 38 is shown on tube 15. It can be appreciated that the outer diameter of the external surface 56 of tube 15 located adjacent to nozzle insert 14 must be smaller than the outer diameter located away from nozzle insert 14 so that opening hydraulic surface 37 is produced. Furthermore, opening hydraulic surface 27 is shown on HCCI needle portion 25. The forces on these surfaces, along with closing hydraulic surface 28 (shown in FIG. 1), dictate when the HCCI needle valve member 12 and conventional needle valve member 13 are in their respective open and closed positions. FIG. 2 also clearly displays the HCCI frustoconical valve surface 40 located on the HCCI needle piston portion 23 and the HCCI frustoconical valve seat 41 located on the nozzle insert 14. As previously stated, HCCI valve surface 40 and HCCI valve seat 41 should be closely concentric about a common centerline in order to achieve complete closure. Also present is the frustoconical conventional valve seat 43, which is located on the tip of the nozzle or injector body. These are valving surfaces, along with the conventional valve surface 42 (shown in FIG. 1), that dictate whether nozzle supply passage 34 is in fluid communication with the HCCI nozzle outlets 16 or the conventional nozzle outlets 17.

Figure 3A:
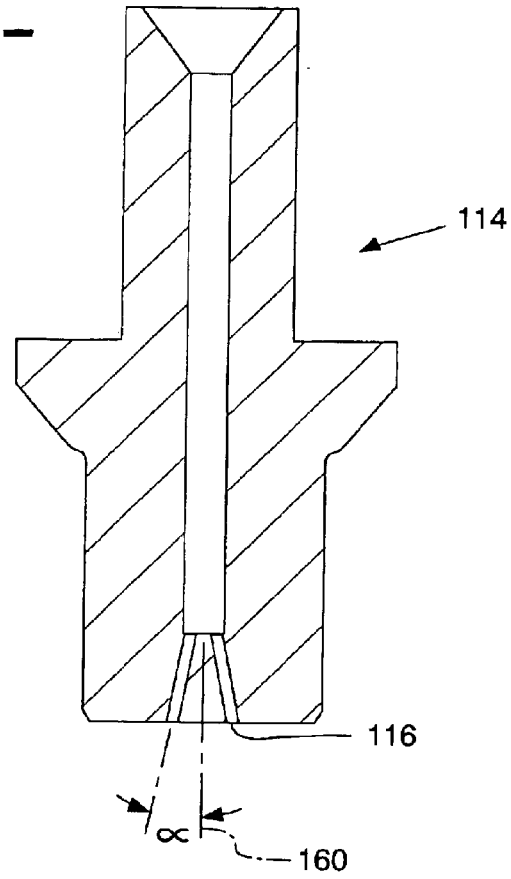
FIG. 3*a* is a sectioned front view of a non-impinging nozzle insert according to the present invention.
Figure 3B:
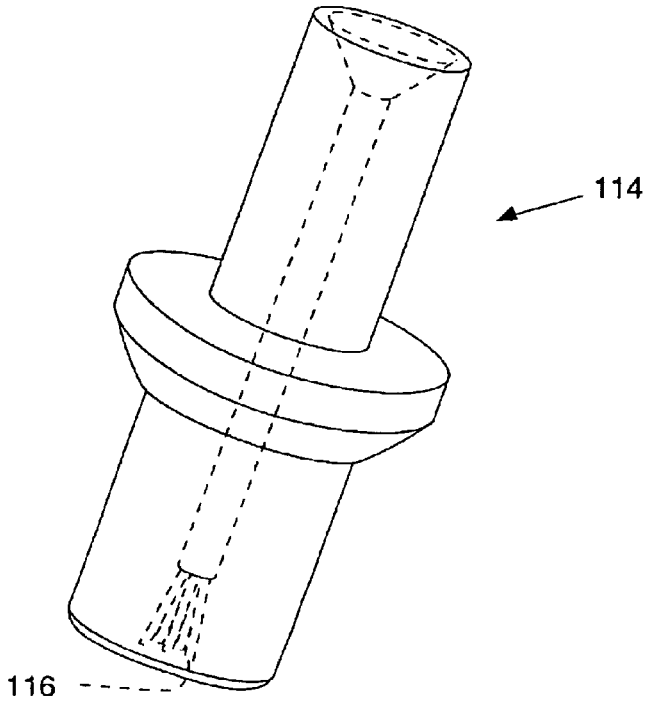
FIG. 3*b* is an isometric view of the non-impinging nozzle insert in FIG. 3*a;*

Referring now to FIGS. 3*a–b*, a nozzle insert 114 is shown with a non-impinging spray formation. Nozzle insert 114 contains six individual HCCI nozzle outlets 116. The nozzle insert 114 is described as non-impinging because the streams of fuel do not substantially intersect upon exiting HCCI nozzle outlets 116. It can be appreciated that the number of outlets could vary depending on the particular fuel injector application. The HCCI nozzle outlets 116 are shown as being set at an angle $\alpha$ from the nozzle insert 114 centerline 160 which is preferably on the order of 20 degrees. It can also be appreciated that angle $\alpha$ can vary depending on the application and such variance will alter fuel air mixing that takes place after the HCCI injection.

Figure 4A:
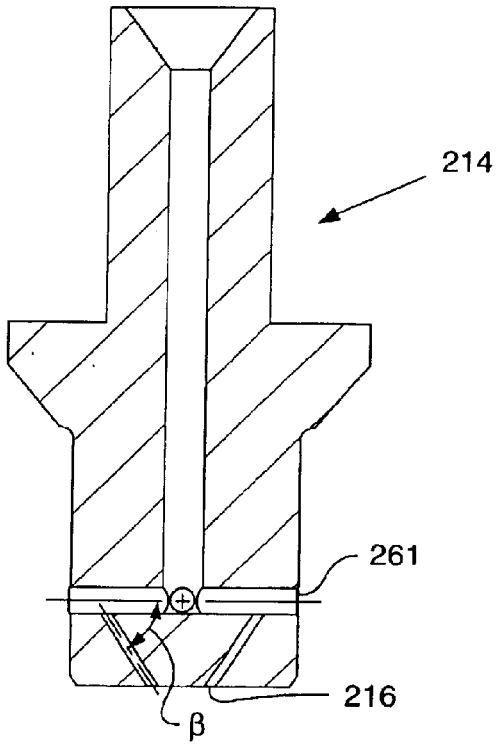
FIG. 4*a* is a sectioned front view of an impinging nozzle insert according to another embodiment of the present invention.
Figure 4B:
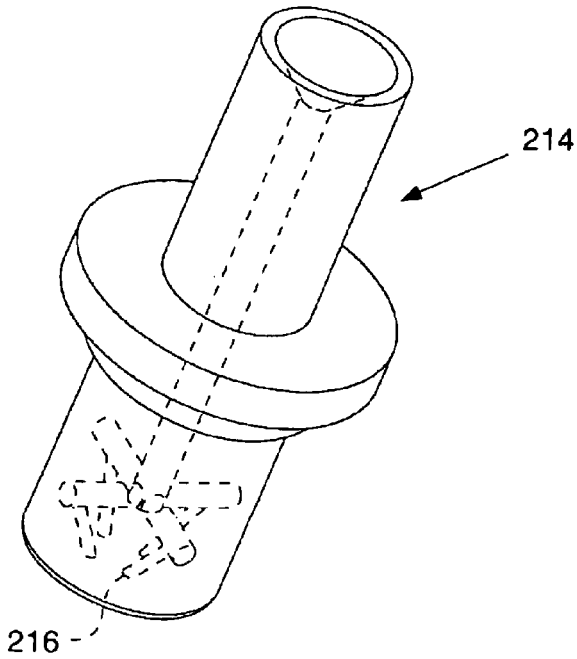
FIG. 4*b* is an isometric view of the non-impinging nozzle insert in FIG. 4*a;*

Referring now to FIGS. 4*a–b*, a nozzle insert 214 is shown with a impinging spray formation. Nozzle insert 214 contains four individual HCCI nozzle outlets 216. The nozzle insert 214 is described as impinging because the outlets fuel spray cones intersect, or overlap, at a point or region after exiting HCCI nozzle outlets 216. It can be appreciated that the number of outlets could vary depending on the particular fuel injector application. The HCCI nozzle outlets 216 are shown as being set at an angle $\beta$ from a line through centerline of cross drilled holes 261 in nozzle insert 214, which are preferably on the order of 60 degrees. It can also be appreciated that angle $\beta$ can vary depending on the application and such variance will alter fuel air mixing action. Finally, it should be noted that crossed drilled holes 261 define openings in nozzle insert 214 that open through the guide portion, and thus fuel leakage is minimized because of the close diametrical clearance. It can be appreciated that plugs could also be used to prevent leakage along the guide bore.

Figure 5A:
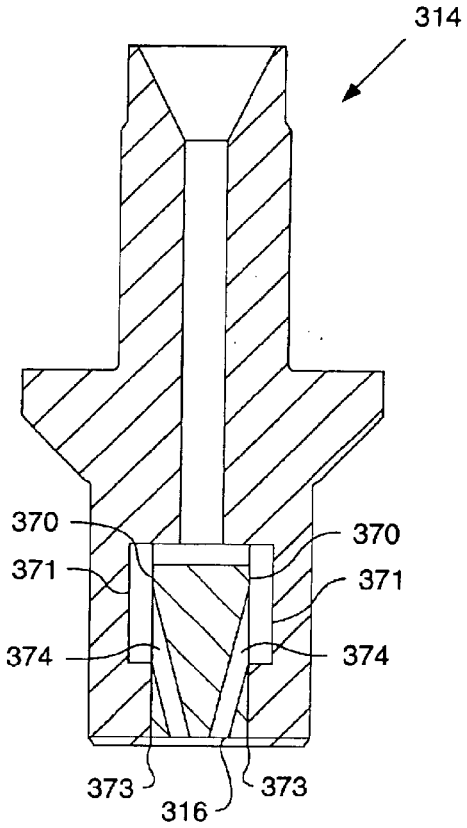
FIG. 5*a* is a sectioned front view of an impinging nozzle insert utilizing a plug insert according to another embodiment of the present invention.
Figure 5B:
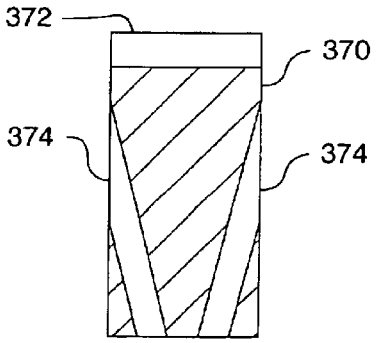
FIG. 5*b* is a sectioned front view of the plug insert shown in FIG. 5*a;*
Figure 5C:
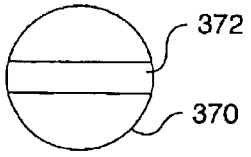
FIG. 5*c* is a top view of the plug insert of FIG. 5*b;*

Referring now to FIGS. 5*a–c*, another nozzle insert 314 is shown with another variation on a impinging model for the present invention. During the machining process, a long narrow opening is bored into the top end of nozzle insert 314. Further, a hole is counter-bored into the bottom end of nozzle insert 314. The female mating diameter of the counter-bored hole is preferably about the same dimension as the male mating diameter of plug insert 370. Recessed within the nozzle insert 314 hole should preferably contain an annulus 371 which extend the diameter of the hole. Plug insert 370 is pressed fit into the bottom end of nozzle insert 314 such that the resulting piece behaves as a single part. In addition, a welding circle 373 where the nozzle insert 314 and plug insert 370 connect is created to further strengthen the nozzle insert 314.

Now referring in particular to FIG. 5*b–c*, plug insert 370 contains a slot 372 that is grounded into the top of the plug insert 370 and extends down into plug insert 370 for a specified distance. The plug insert 370 preferably also contains two bores 374 that are bored into it from the bottom end. Bores 374 will create two outlets at the end of the plug which will define the HCCI nozzle outlet 316. In other words, the fuel will pass downward through the passage opening of nozzle insert 314, into the slot 372, proceed to the annulus 371, and finally into bores 374 before the fuel exits the plug insert 314. It can be appreciated that the fuel stream will create an impinging intersection point that is located outside the plug insert. Furthermore, it can appreciated that the dimensions of slot 372, annulus 371 and bores 374 will vary depending the type of fuel spray desired.

Figure 6:
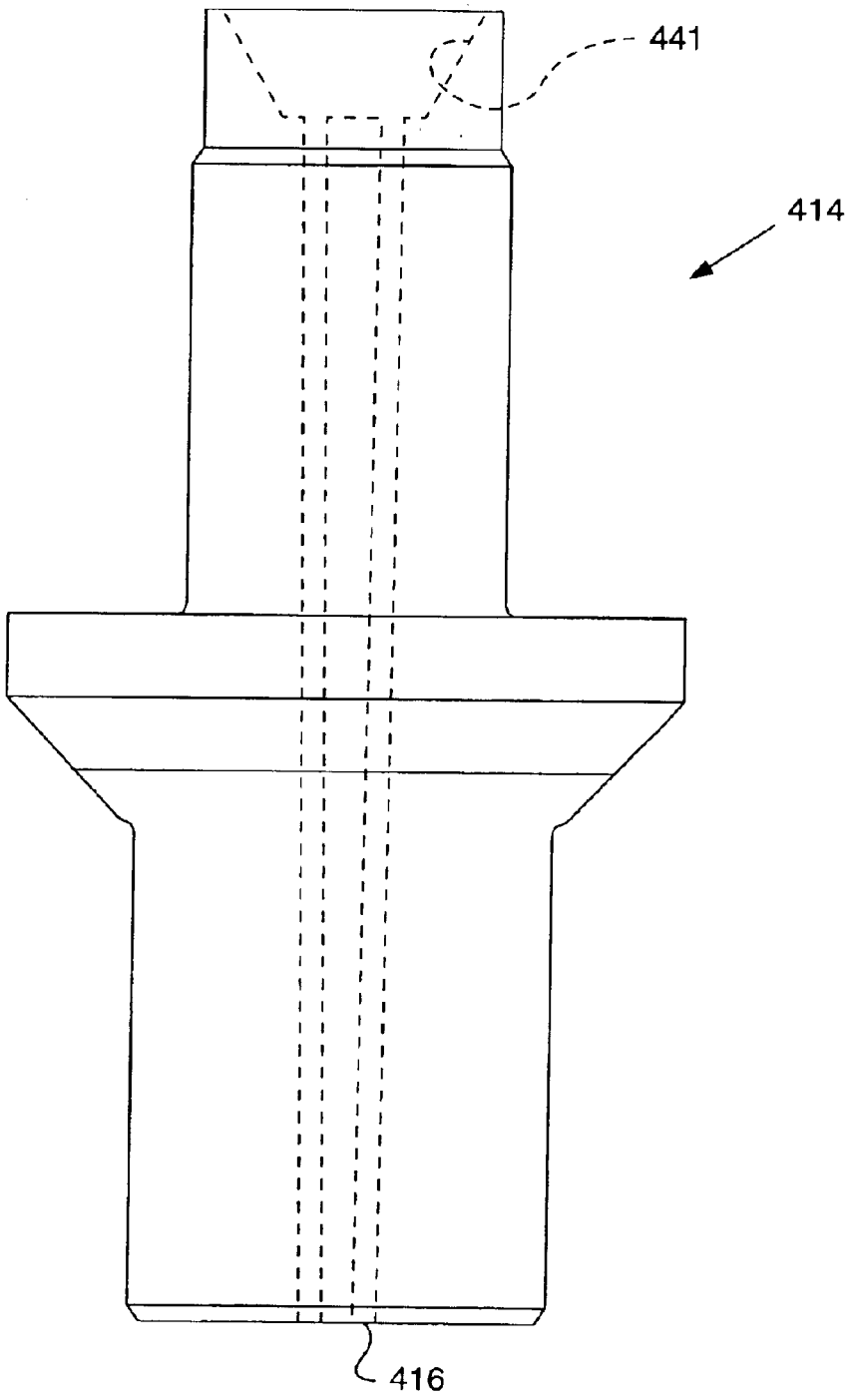
FIG. 6 is a front view of an impinging nozzle insert according to another embodiment of the present invention.

Referring now to FIG. 6, another nozzle insert 414 is shown with another variation on an impinging model for the present invention. Instead of a single cylindrical hole extending from HCCI valve seat 441, nozzle insert 14 contains multiple cylindrical holes that define the HCCI nozzle outlets 416. The nozzle insert 414 in FIG. 6 represents two holes but it can be appreciated that the number of holes may vary according to the application. It can be appreciated that the fuel stream will create an impinging point that is located outside the nozzle insert 414.

Figure 7:
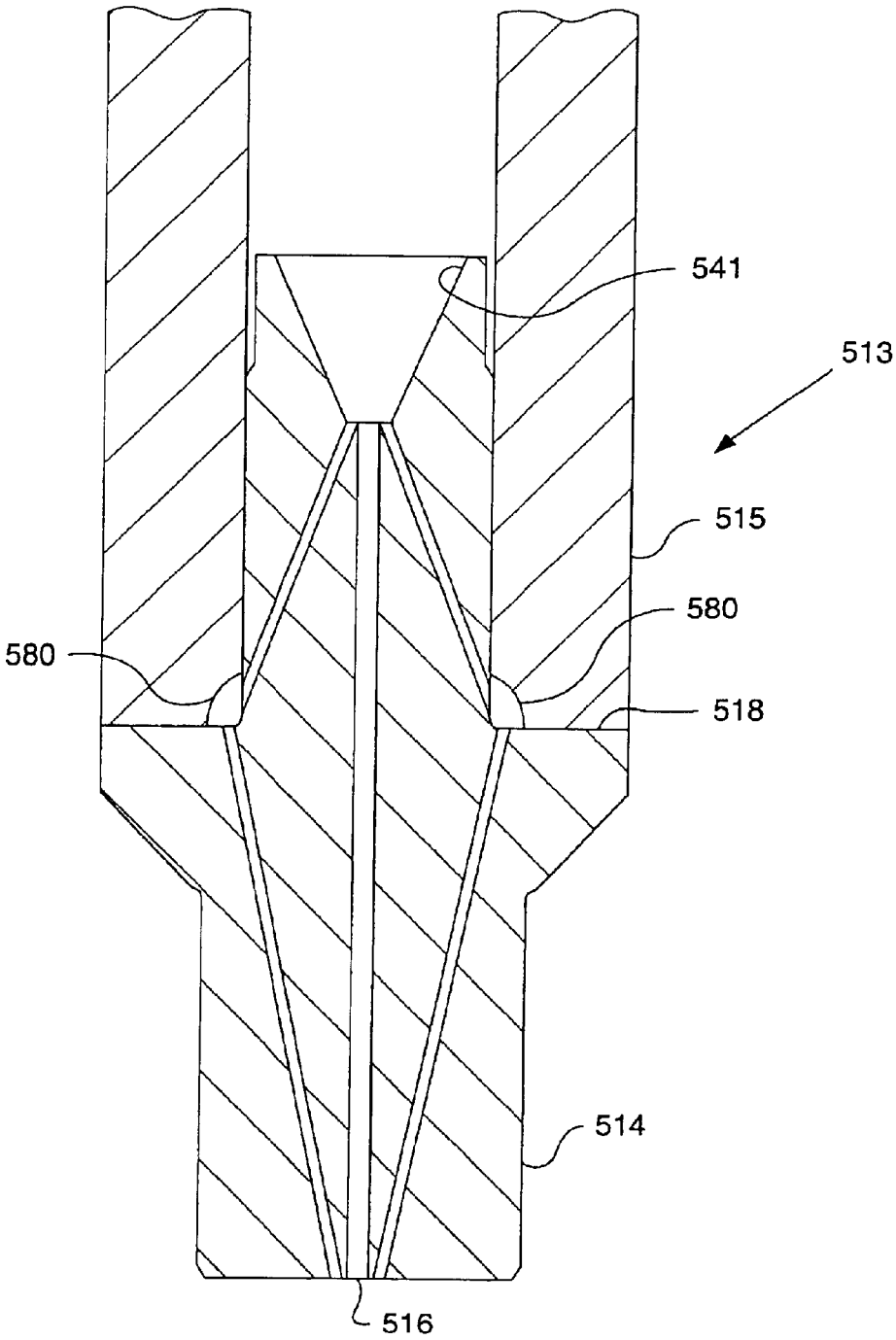
FIG. 7 is a partial sectioned front view of a needle valve member according to still another embodiment of the present invention.

Referring now to FIG. 7, another nozzle insert 14 is shown with another variation on an impinging model for the present invention. This particular nozzle insert 14 contains four holes drilled within its body extending from HCCI valve seat 41. The holes begin at the passage opening of the HCCI valve seat 41 and extend at an angle such that the holes appear from the cylindrical surface where the tube 15 and nozzle insert 14 are press fit together. Take note that tube 15 in this embodiment of the invention shall have a small annular cavity 80 so that the fuel can easily pass through the holes in the upper portion of nozzle insert 14. Extending downward from the cavity 80 in tube 15, four more holes are contained in the lower portion of the nozzle insert 14 and functionally aligned with the holes in the top portion. These bottom holes are bored such that they meet to form the HCCI nozzle outlets 16. It can be appreciated that the fuel stream will create an impinging point that is located outside nozzle insert 14. While FIG. 7 displays four nozzle outlets 16, one skilled in the art can appreciate a different plurality of nozzle outlets 16 ranging from two outlets to a higher amount.

INDUSTRIAL APPLICABILITY

Returning now to FIGS. 1*a–b*, prior to a fuel injection event, HCCI needle valve member 12 and conventional needle valve member 13 are in their respective downward closed positions. HCCI needle valve member 12 blocks HCCI nozzle outlets 16 while conventional needle valve member 13 blocks conventional nozzle outlets 17.

Prior to an HCCI injection event, the fuel pressure in the fuel pressurization chamber 39 reaches an HCCI valve opening pressure which is communicated to fuel transfer passage 35 via nozzle supply passage 34. The fuel acts on the opening hydraulic surface 28 to counter the biasing force of biasing spring 21 and the reduced fluid pressure acting on closing hydraulic surface 28. Upon reaching the HCCI valve opening pressure, the HCCI needle valve member 12 is lifted from HCCI valve seat 41 and HCCI nozzle outlets 16 are in fuel communication with fuel transfer passage 35. Consequently, fuel can be sprayed into the engine cylinder. Once the required amount of fuel is released, the fluid pressure in HCCI needle control chamber 24 is raised such that the combined forces of HCCI biasing spring 21 and fluid pressure on closing hydraulic surface 28 is greater than the opening fuel pressure force in fuel pressurization chamber 39.

Prior to an conventional injection event, the fuel pressure in the fuel pressurization chamber 39 reaches a conventional valve opening pressure (which is less than HCCI valve opening pressure) which is communicated to opening hydraulic surface 37 via nozzle supply passage 34. The fuel acts on the opening hydraulic surface 37 to counter the fluid pressure acting on closing hydraulic surface 38, the biasing force exerted by conventional biasing spring 31, the fluid pressure acting on closing hydraulic surface 28 and the biasing force exerted by HCCI biasing spring 21.

Upon reaching the conventional valve opening pressure, the conventional needle valve member 13 is lifted from conventional valve seat 43 and conventional nozzle outlets 17 are in fuel communication with nozzle supply passage 34. Consequently, fuel can be sprayed into the engine cylinder. When conventional needle valve member 13 is lifted, HCCI needle valve member is also lifted but remains in contact with HCCI valve seat 41. Therefore, fuel cannot be injected through HCCI nozzle outlets 16. The injection event is ended by resuming high pressure in HCI needle control chamber 24 causing both needles to move downward toward their closed positions.

Referring now to FIG. 2 where conventional needle valve member 13 is shown to include two separate parts, nozzle insert 14 and tube 15 being joined together.

Nozzle insert 14 is a metallic body being preferably machined in a single setting to include a cylindrical guide surface 51, annular conical valve surface 42, cylindrical mating surface 52 and valve seat 41, so that all of these features are as concentric as possible. One end of nozzle insert 14 contains passage 18, which includes an HCCI valve seat 41. At the opposite end, HCCI nozzle outlets 16 are bored into nozzle insert 14. Preferably, the machining of nozzle insert 14 can occur in a single setting in order to eliminate differences associated with exchanging parts during the typical construction of metallic pieces.

Tube 15 is likewise preferably machined in a single setting and inner diameter 19 of tube 15 and the second cylindrical surface 52 of nozzle insert 14 preferably have only slightly differing diameters.

Nozzle insert 14 and tube 15 are pressed fit together and welded to create an irreversible single metallic piece. The advantages of attaching nozzle insert 14 and tube 15 together in this manner are several. The size and length of conventional needle valve member 13 does not allow one to perform the requisite deep seat grinding needed for positioning of HCCI needle valve member 12. Therefore, by splitting conventional needle valve member 13 into two separate parts, HCCI valve seat 41 can be ground without any machining difficulties.

Press fitting the nozzle insert 14 and tube 15 together eliminates the problem of concentricity associated with other means of attachment such as threading. Threading does not produce the proper centerline alignment needed for a fuel injector that has minimal diametrical clearances between its HCCI needle valve member 12 and conventional needle valve member 13. Any slight centerline misalignment could create the slightest bit of contact and the needle could become stuck or jammed. Press fitting also allows for nozzle insert 14 and tube 15 to be irreversibly attached, therefore avoiding the possibility of needle breakage under the high pressures of the fuel injector.

Now referring to FIGS. 3–7, nozzle insert 14 can be machined to include several different HCCI nozzle outlets 16 formations. Every formation has its advantages but each can be classified as being impinging, non-impinging or mixed. A non-impinging model has outlets that produce fuel spray cones that do not substantially intersect one another in the engine cylinder. On the other hand, an impinging model has outlets that produce spray cones that substantially intersect after entering the compression chamber. Both models will alter the fuel air mixing in the engine cylinder that takes place after HCCI injection.

The above description is for illustrative purposes only, and is not intended to limit the scope of the invention in any way. Those skilled in the art will appreciate that a wide variety of modifications could be made to the illustrated nozzle inserts without departing from the intended scope of the invention, which is defined by the claims set forth below.

What is claimed is:

1. A needle valve member for a fuel injector comprising:

a nozzle insert having an external valve surface, an internal valve seat and at least one nozzle outlet;

a tube irreversibly attached to said nozzle insert;

said nozzle insert includes a cylindrical male mating surface; and said tube having a cylindrical female mating surface mated to said cylindrical male mating surface of said nozzle insert.

2. A needle valve member for a fuel injector comprising:

a nozzle insert having an external valve surface, an internal valve seat and at least one nozzle outlet;

a tube irreversibly attached to said nozzle insert;

said tube includes an external surface with a first diameter adjacent said nozzle insert and a second diameter away from said nozzle insert; and said first diameter is smaller than said second diameter, and said first diameter is separated from said second diameter by an opening hydraulic surface.

3. The needle valve member of claim 2 wherein said at least one nozzle outlet includes a plurality of nozzle outlets that are oriented into at least one of a non-impinging spray pattern and an impinging spray pattern.

4. The needle valve member of claim 3 wherein said nozzle insert has a circumferential side surface that includes said external valve surface positioned between a guide cylindrical surface and a mating cylindrical surface;

said guide cylindrical surface has a guide length and a guide diameter that is smaller than said guide length; and said mating cylindrical surface has a mating length and a mating diameter that is smaller than said mating length.

5. A needle valve member for a fuel injector comprising:

a nozzle insert having an external valve surface, an internal valve seat and at least one nozzle outlet;

a tube irreversibly attached to said nozzle insert; and said at least one nozzle outlet includes a plurality of nozzle outlets that are oriented into at least one of a non-impinging spray pattern and an impinging spray pattern.

6. A needle valve member for a fuel injector comprising:

a nozzle insert having an external valve surface, an internal valve seat and at least one nozzle outlet;

a tube irreversibly attached to said nozzle insert; and said nozzle insert has a circumferential side surface that includes said external valve surface positioned between a guide cylindrical surface and a mating cylindrical surface.

7. The needle valve member of claim 6 wherein said guide cylindrical surface has a guide length and a guide diameter that is smaller than said guide length.

8. The needle valve member of claim 6 wherein said mating cylindrical surface has a mating length and a mating diameter that is smaller than said mating length.

9. A fuel injector comprising:

an injector body defining a plurality of second nozzle outlets and including a valve seat;

a needle valve member comprising a nozzle insert having an external valve surface for contacting and closing said valve seat, an internal valve seat for receiving a valve member, and at least one nozzle outlet, and including a tube irreversibly attached to said nozzle insert the needle valve member being at least partially positioned in said injector body and being movable as a unit between a first position out of contact with said valve seat of said injector body in which said second nozzle outlets are open, and a second position in contact with said valve seat of said injector body in which said second nozzle outlets are closed.

10. The fuel injector of claim 9 wherein said nozzle insert includes a cylindrical male mating surface; and said tube having a cylindrical female mating surface mated to said cylindrical male mating surface of said nozzle insert.

11. The fuel injector of claim 9 wherein said tube includes an external surface with a first diameter adjacent said nozzle insert and a second diameter away from said nozzle insert; and said first diameter is smaller than said second diameter, and said first diameter is separated from said second diameter by an opening hydraulic surface.

12. The fuel injector of claim 9 wherein said at least one nozzle outlet includes a plurality of first nozzle outlets that are oriented into at least one of a non-impinging spray pattern and an impinging spray pattern.

13. The fuel injector of claim 9 wherein said nozzle insert has a circumferential side surface that includes said external valve surface positioned between a guide cylindrical surface and a mating cylindrical surface.

14. The fuel injector of claim 13 wherein said guide cylindrical surface has a guide length and a guide diameter that is smaller than said guide length.

15. The fuel injector of claim 13 wherein said mating cylindrical surface has a mating length and a mating diameter that is smaller than said mating length.

16. The fuel injector of claim 9 wherein said tube includes an external surface with a first diameter adjacent said nozzle insert and a second diameter away from said nozzle insert, and said first diameter is smaller than said second diameter;

said at least one nozzle outlet includes a plurality of first nozzle outlets that are oriented into at least one of a non-impinging spray pattern and an impinging spray pattern.

17. The fuel injector of claim 16 wherein said nozzle insert has a circumferential side surface that includes said external valve surface positioned between a guide cylindrical surface and a mating cylindrical surface;

said guide cylindrical surface has a guide length and a guide diameter that is smaller than said guide length; and said mating cylindrical surface has a mating length and a mating diameter that is smaller than said mating length.

18. The fuel injector of claim 9 wherein said at least one nozzle outlet has a first spray pattern; and said plurality of second nozzle outlets have a different spray pattern.

19. The fuel injector of claim 18 wherein said at least one nozzle outlet is at least one homogeneous charge outlet; and said plurality of second nozzle outlets include a plurality of conventional nozzle outlets.

* * * * *